US007614569B2

(12) United States Patent
Lavacot

(10) Patent No.: US 7,614,569 B2
(45) Date of Patent: Nov. 10, 2009

(54) STREAM NOZZLE

(76) Inventor: Kenneth R. Lavacot, 21515 Via Espana, Yorba Linda, CA (US) 92886

( * ) Notice: Subject to any disclaimer, the term of this patent is extended or adjusted under 35 U.S.C. 154(b) by 472 days.

(21) Appl. No.: 11/205,471

(22) Filed: Aug. 16, 2005

(65) Prior Publication Data

US 2007/0040044 A1 Feb. 22, 2007

(51) Int. Cl.
*B05B 15/08* (2006.01)
*B05B 15/06* (2006.01)
*B05B 15/10* (2006.01)

(52) U.S. Cl. ..... 239/201; 239/203; 239/587.1; 239/587.4; 239/588; 239/DIG. 1

(58) Field of Classification Search ... 239/587.1–587.5, 239/280, 280.5, 200, 207, 203–206, 229, 239/243, 246, 247, 548, 569, 583, 588, DIG. 1, 239/201
See application file for complete search history.

(56) References Cited

U.S. PATENT DOCUMENTS 2,202,349 A * 5/1940 Lewis ..... 239/247
3,684,179 A * 8/1972 Fischer et al. ..... 239/203
3,940,066 A * 2/1976 Hunter ..... 239/204
4,634,052 A * 1/1987 Grizzle et al. ..... 239/205
5,031,840 A * 7/1991 Grundy et al. ..... 239/456
5,058,806 A * 10/1991 Rupar ..... 239/205
5,226,602 A * 7/1993 Cochran et al. ..... 239/583
5,240,184 A * 8/1993 Lawson ..... 239/499
5,360,167 A * 11/1994 Grundy et al. ..... 239/460
5,826,803 A * 10/1998 Cooper ..... 239/556
5,947,386 A * 9/1999 Dick et al. ..... 239/201
6,050,502 A * 4/2000 Clark ..... 239/237
6,568,610 B1 * 5/2003 Ericksen ..... 239/588

* cited by examiner

*Primary Examiner*—Darren W Gorman
(74) *Attorney, Agent, or Firm*—Kenneth L. Green; Edgar W. Averill, Jr.

(57) ABSTRACT

A stream nozzle resides between a water source and a sprinkler nozzle and provides a stream of water for watering a bush, shrub, or tree. The stream nozzle may either reside between a fixed height riser and a nozzle, or under the nozzle of a pop-up sprinkler. In the case of a fixed height riser, the stream nozzle may be attached to an adapter or directly to the riser. In the case of a pop-up sprinkler, the stream nozzle is preferably attached to an independently rotatable collar below the nozzle. The stream nozzle is preferably adjustable in elevation angle and in azimuth angle.

13 Claims, 6 Drawing Sheets

STREAM NOZZLE

BACKGROUND OF THE INVENTION

The present invention relates to irrigation and in particular to providing a directed stream of water to shrubs, trees, and the like.

Plants are generally used to provide inviting outdoor scenery. Often plants are introduced into areas where they do not naturally occur and in many instances these areas do not receive sufficient rainfall to support the plants. In these instances, irrigation must be utilized to provide sufficient water to the plants.

The most common form of irrigation comprises spray nozzles which spray a pattern of water onto a planted area. The nozzles may be a round pattern, a half round pattern, a quarter round pattern, a rectangular pattern, or the like. All of these patterns have a common problem of providing a spray to an area, versus targeting a single plant. As a result, water is spayed onto areas not requiring irrigation. Further, some plants benefit from deep watering. Specifically, it is desire: to saturate a small area around the plant to promote deep root growth. When known spray nozzles are used, a large surface area is uniformly watered, and shallow root growth results.

One alternative to using spray nozzles is a drip irrigation system. Such drip irrigation systems include manifolds and individual lines running to each plant. While a drip irrigation system may provide the desired concentration and resulting deep watering required for some plants, the numerous lines may be inadvertently cut or moved out of their original positions during subsequent yard work. A tree or shrub may die due to lack of water before the damage to the drip system is recognized.

There is thus a need for an irrigation system which provides directed watering without individual lines running to each plant.

BRIEF SUMMARY OF THE INVENTION

The present invention addresses the above and other needs by providing a stream nozzle which resides between a water source and a sprinkler nozzle and provides a stream of water for watering a bush, shrub, or tree. The stream nozzle may reside either between a fixed height riser and a nozzle, or under the nozzle of a pop-up sprinkler. In the case of a fixed height riser, the stream nozzle may be attached to an adapter or directly to the riser. In the case of a pop-up sprinkler, the stream nozzle is preferably attached to an independently rotatable collar below the nozzle. The stream nozzle is preferably adjustable in elevation and in azimuth.

In accordance with one aspect of the invention, there is provided a stream watering apparatus comprising a water source, a sprinkler nozzle in fluid communication with the water source, and stream nozzle residing between the water source and the sprinkler nozzle. The stream nozzle is adjustable to independently change an elevation angle of the stream nozzle and an azimuth angle of the stream nozzle, relative to the sprinkler nozzle.

In accordance with another aspect of the invention, there is provided a watering system comprising a water source, underground water lines, risers connected to the underground water lines, a sprinkler nozzle in fluid communication with the risers, and a stream nozzle residing between the water source and the sprinkler nozzle. The stream nozzle is adjustable to independently change an elevation angle of the stream nozzle and an azimuth angle of the stream nozzle, relative to the sprinkler nozzle.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

Figure 1:
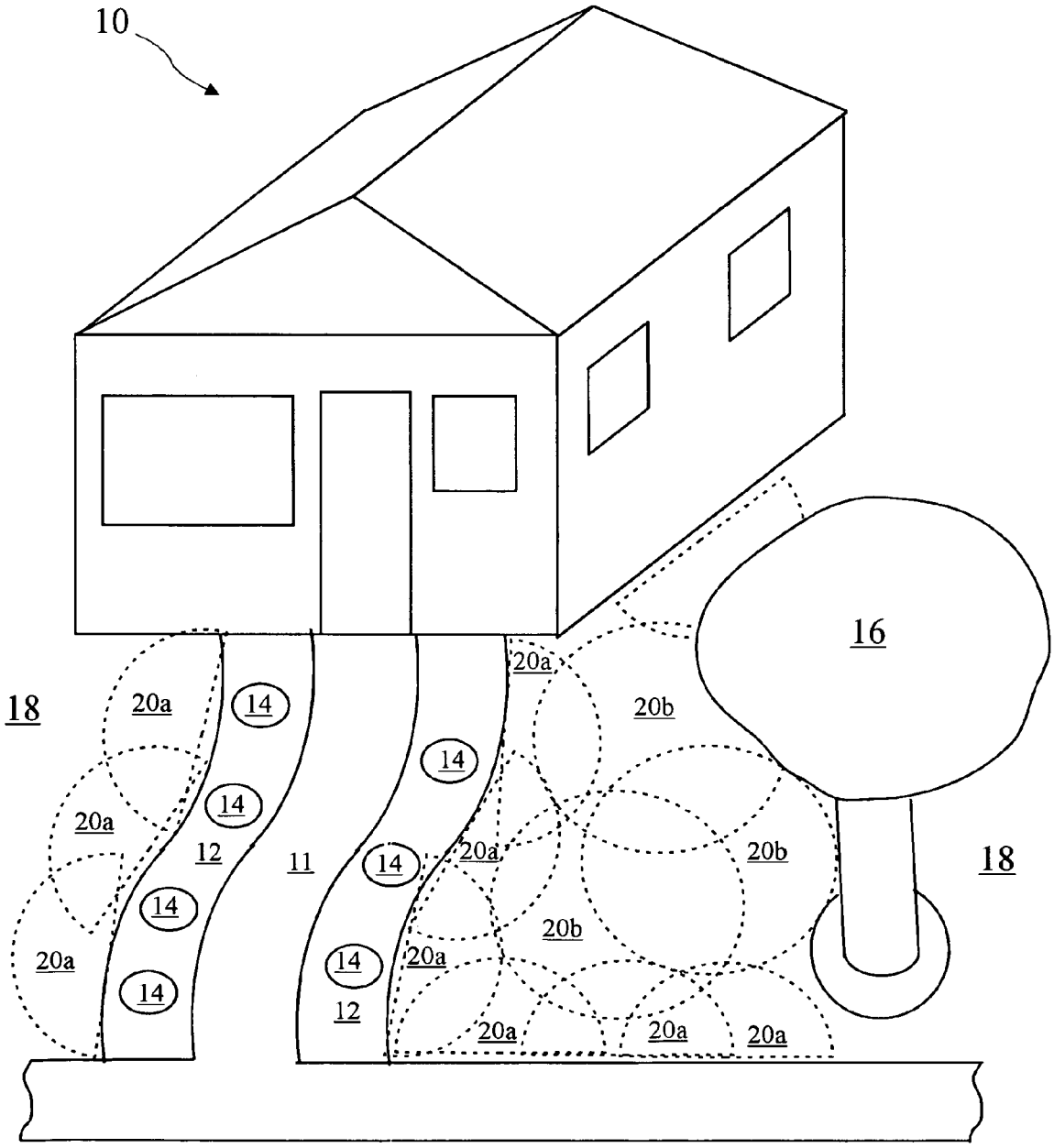
FIG. 1 (prior art)
FIG. 1 is a prior art sprinkler system.

The following description is of the best mode presently contemplated for carrying out the invention. This description is not to be taken in a limiting sense, but is made merely for the purpose of describing one or more preferred embodiments of the invention. The scope of the invention should be determined with reference to the claims.

A prior art sprinkler system is shown arranged around a home 10. The sprinkler system includes half circle pattern sprinklers 20*a* and full circle pattern sprinklers 20*b*. Other sprinkler patterns such as quarter pattern, strip pattern, and the like are commonly used. Planted areas around the home 10 include planters 12 along a walkway 11, and lawns 18. While the sprinklers 20*a* and 20*b* provide a uniform coverage desirable for the lawns 18, they do not provide the concentrated coverage desirable for shrubs 14 or trees 16.

Figure 2:
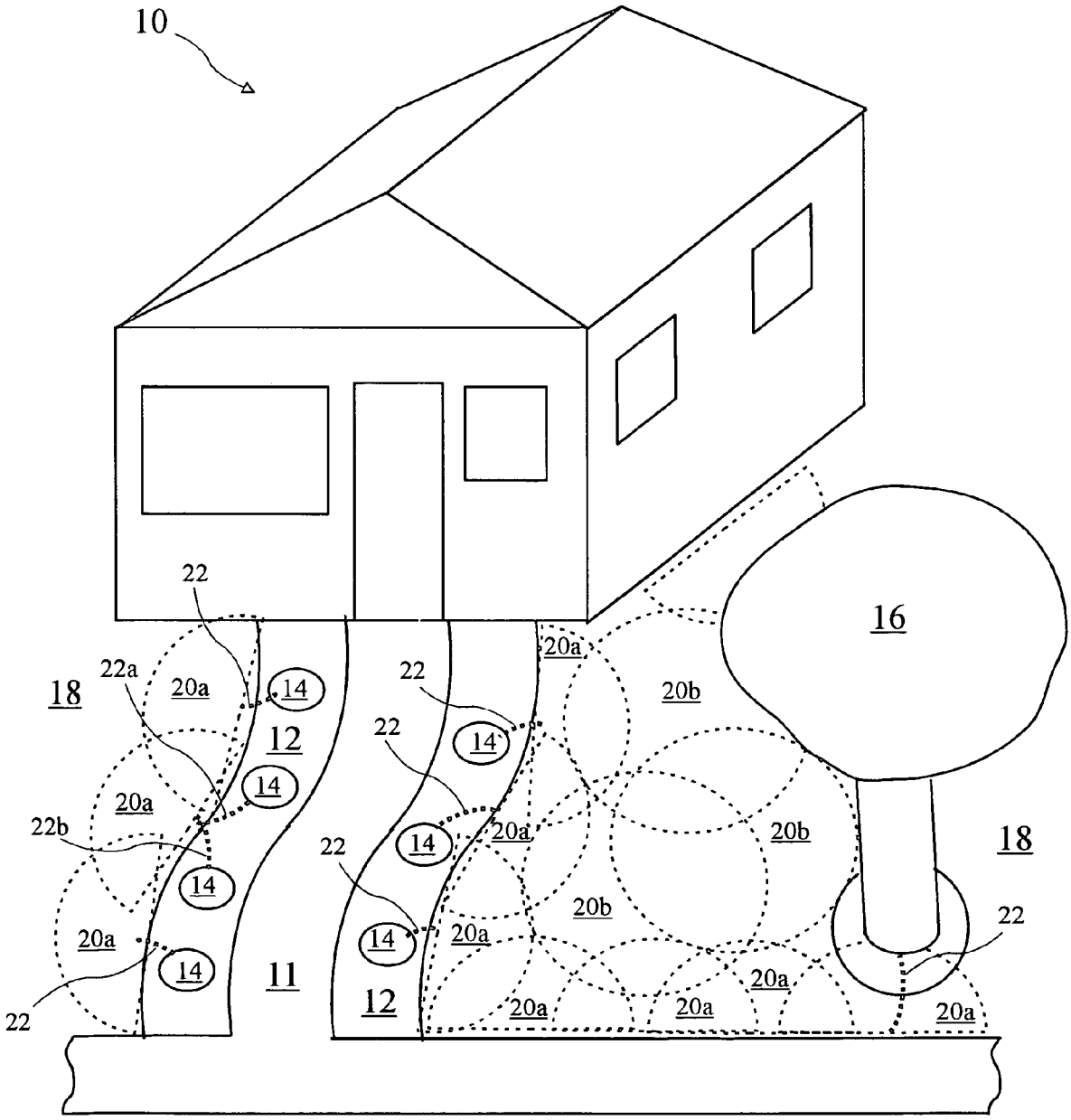
FIG. 2 is a sprinkler system with stream nozzles according to the present invention residing between water sources and sprinkler nozzles.

An improved sprinkler system with stream nozzles according to the present invention is shown in FIG. 2. The stream nozzles provide water streams 22 for concentrated watering of shrubs 14, trees 16, and the like. The stream nozzles are further configured to augment existing sprinklers and thus do not require additional sprinkler lines to be installed. The water streams 22 may further be used to provide water to any object requiring periodic addition of water, for example, fountains, bird baths, ponds, and the like.

Figure 3A:
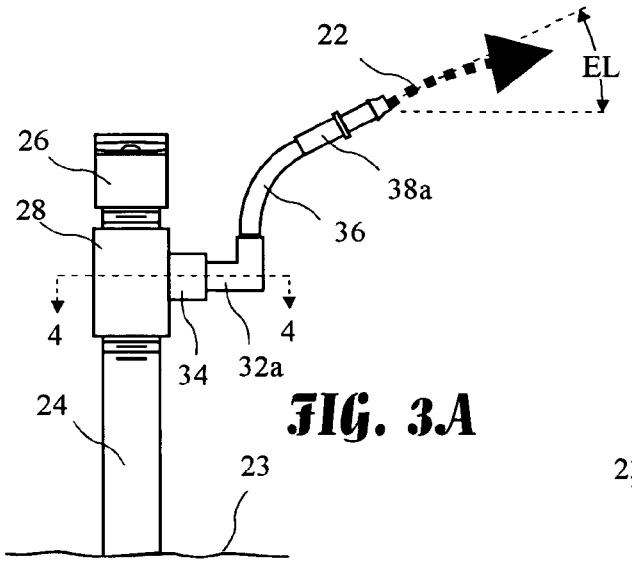
FIG. 3A shows the stream nozzle connected to an adapter according to the present invention.

A first stream nozzle 38*a* connected between a riser 24 and a sprinkler nozzle 26 by an adapter 28, is shown in FIG. 3A. The adapter 28 generally includes a female-threaded end for connecting to the riser 24, and a male-threaded end for the nozzle 26. The adapter 28 may thus be added to an existing sprinkler 26 position by removing the sprinkler 26 from the riser 24, screwing the adapter 28 onto the riser 24, and screwing the sprinkler 26 onto the adapter 28. The adapter includes a shoulder 34 which may be molded into the adapter 28. The shoulder 34 receives a first fitting (for example an elbow) 32*a*, and a bendable arm 36 slides over the fitting 32*a*. The stream nozzle 38*a* is inserted into the arm 36 and held in place on the arm 36 by a friction fit, barbs, glue, clamp, or by any means suitable for holding the stream nozzle 38*a* on the arm 36. The arm is similarly held in place on the shoulder 32*a*. The riser 24, adapter 28, and sprinkler 26 are horizontally aligned, meaning that they are aligned when looked down from a top view.

The fitting 32*a* may be straight or may be an angled elbow, and is preferably a 90 degree elbow. If the fitting 32*a* is an elbow, the fitting may be rotated in the shoulder 34 to aim the stream nozzle 38*b*. Further, the arm 36 is configured to retain a shape once bent, and to retain a new shape when bent again. The arm preferably is a flexible tide with a metal wire 44 (see FIG. 4) running through the tube.

Figure 3B:
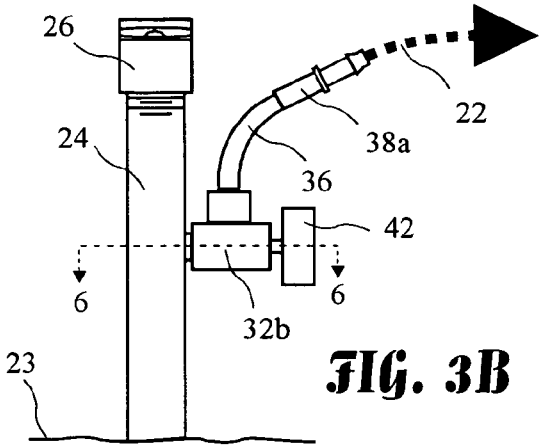
FIG. 3B shows the stream nozzle connected directly to a riser.

The stream nozzle 38*a* is shown connected directly to the riser 24 in FIG. 3B. A second fitting 32*b* penetrates a wall of the riser 24, and includes a needle valve 42 for adjusting the flow of water to the stream nozzle 38*a*.

Figure 4:
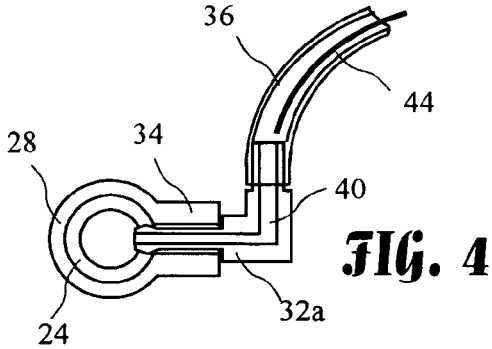
FIG. 4 shows a cross-sectional view of the adapter taken along line 4-4 of FIG. 3A.

A cross-sectional view of the adapter 28 taken along line 4-4 of FIG. 3A is shown in FIG. 4. The fitting 32*a* extends through the shoulder 34 and into the interior of the adapter 28, thus into fluid communication with water provided by the riser 24 to the sprinkler nozzle 26. A passage 40 in the fitting 32*a* carries the water to the arm 36. The wire 44 resides inside the arm 36 to hold a position the arm 36 is bent into. The arm 36 may also comprise structure to retain shape when bent, for example, the arm 36 may be a corrugated tube made from metal, plastic, or any water compatible material, may be ball joint tubing, or the like.

Figure 5:
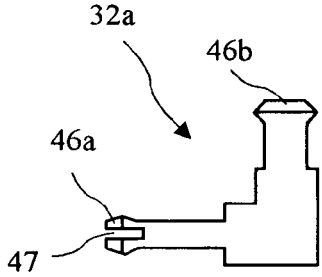
FIG. 5 shows a detailed view of an fitting configured for cooperation with the adapter.

A detailed view of an fitting 32*a* is shown in FIG. 5. The fitting 32*a* preferably includes a first flair 46*a* for retaining the fitting 32*a* in the adapter 28, and a second flair 46*b* for retaining the arm 44 on the fitting 32*a*. A slice 47 preferably separates the flair 46*a* to facilitate insertion of the fitting 32*a* into the adapter 28.

Figure 6:
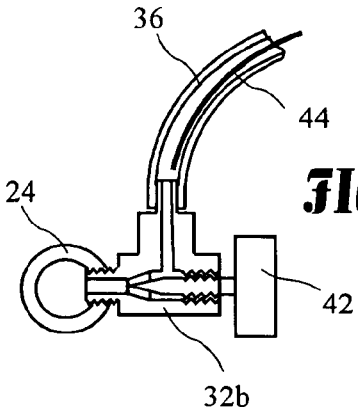
FIG. 6 shows a cross-sectional view of a second fitting according to the present invention, taken along line 6-6 of FIG. 3B.
Figure 7:
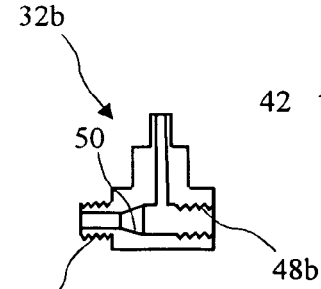
FIG. 7 is a detailed view of the second fitting.

A cross-sectional view of a second fitting 32*b* inserted into a riser 24, taken along line 6-6 of FIG. 3B, is shown in FIG. 6, and a cross-sectional view of the fitting 32*b* alone is shown in FIG. 7. The fitting 32*b* includes first threads 48*a* for attaching (or screwing) the fitting 32*b* into the riser 24. The fitting 32*b* is preferably made from metal, and the threads 48*a* are configured to self tap into an appropriate size hole drilled (or otherwise formed) in a wall of the riser 24. The arm 36 attaches to the fitting 32*b* in a similar fashion as to the fitting 32*a*, and a flair 46*b* (see FIG. 5) may similarly be provided to retain the arm 36 on the fitting 32*b*.

Figure 7A:
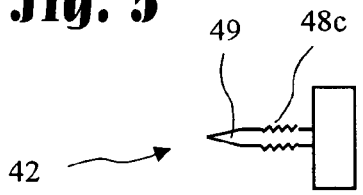
FIG. 7A is a needle valve configured for cooperation with the second fitting.

The needle valve 42, configured for cooperation with the second fitting 32*b*, is shown in FIG. 7A. The needle valve 42 includes a valve tip 49 which cooperates with the valve seat 50 (see FIG. 7) to adjust the flow of water to the stream nozzle 38*a* (see FIG. 3B), and third threads 48*c* for advancing the needle valve 42 into the fitting 32*b*.

Figure 8:
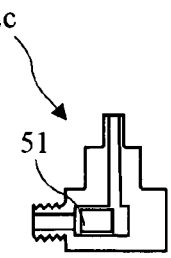
FIG. 8 is a third fitting including a pressure regulator.

A third fitting 32*c* with a pressure regulator 51 is shown in FIG. 8. The pressure regulator may be similar to the pressure regulator incorporated into the stem of the Rainbird 1800-PRS pop-up sprinkler. Such pressure regulator is advantageous where water pressure may vary during, and maintains the aim of the water stream 22.

Figure 9:
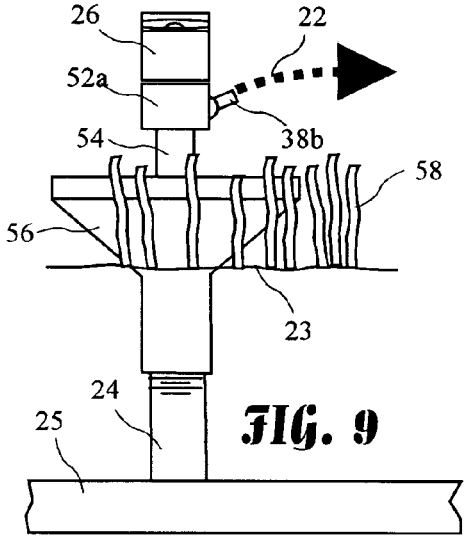
FIG. 9 is a pop-up sprinkler including a stream nozzle according to the present invention.

A pop-up sprinkler including a second stream nozzle 38*b* according to the present invention is shown in FIG. 9. The pop-up sprinkler resides close to the ground 23 and generally approximately flush with grass 58. The pop-up sprinkler includes base 56 and pop-up stem 54 which receive water from the riser 24. A first rotatable collar 52*a* is attached proximal to the top of the pop-up stem 54 and resides under the sprinkler nozzle 26, and a second stream nozzle 38*b* is attached to the collar 52. The collar 52*a* allows the stream nozzle 38*b* to be aimed in azimuth (see FIG. 15) independently from the sprinkler nozzle 26.

Figure 10:
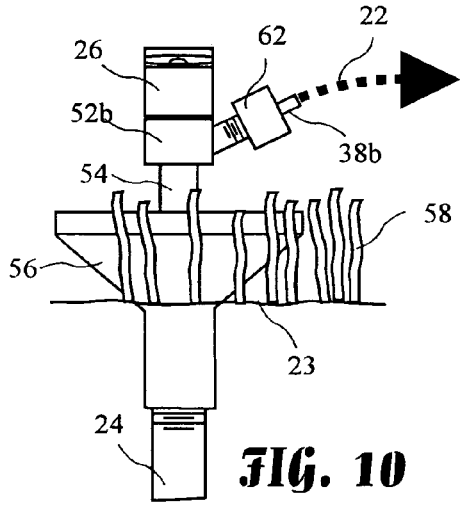
FIG. 10 is a pop-up sprinkler with the stream nozzle attached by a nozzle fixture.

A pop-up sprinkler with the stream nozzle 38*b* attached by a nozzle fixture 62 is shown in FIG. 10. The fixture 62 is attached to a second rotatable collar 52*b*.

Figure 11:
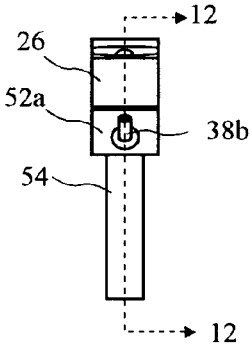
FIG. 11 is a front view of the stream nozzle attached to a pop-up stem.
Figure 12:
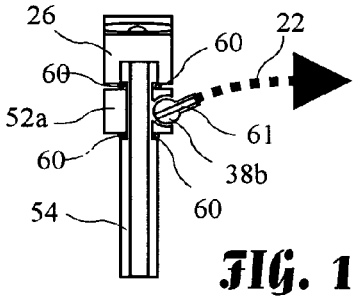
FIG. 12 is a cross-sectional view of the stream nozzle attached to the pop-up stem, taken along line 12-12 of FIG. 11.

A front view of the collar 52*a* and stream nozzle 38*b* attached to a pop-up stem 54, below the sprinkler nozzle 26, is shown in FIG. 11, and a cross-sectional view of the stream nozzle attached to the pop-up stem, taken along line 12-12 of FIG. 11 is shown in FIG. 12. The collar 52*a* preferably resides between seals (for example o-rings) 60, providing a seal, and allowing independent rotation of the collar 52*a* with respect to the sprinkler nozzle 26. The stream nozzle 38*b* is swedged into the collar 52*a* to provide a snug (or friction) fit, allowing adjustment of the stream nozzle 38*b* and holding the position of the stream nozzle 38*b* after adjustment.

Figure 13:
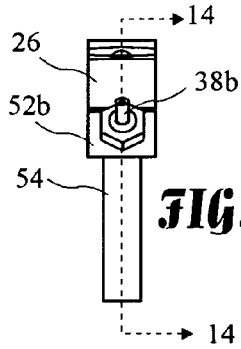
FIG. 13 is a front view of the stream nozzle attached to a pop-up stem by the nozzle fixture.
Figure 14:
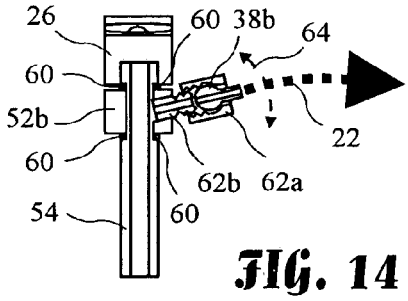
FIG. 14 is a cross-sectional view of the stream nozzle attached to the pop-up stem by the nozzle fixture, taken along line 14-14 of FIG. 13.

A front view of the stream nozzle 38*b* attached to the pop-up stem 54 by a nozzle fixture (or collar) 52*b* is shown in FIG. 13, and a cross-sectional view of the stream nozzle 38*b* attached to the pop-up stem 54 by the nozzle fixture 52*b*, taken along line 14-14 of FIG. 13, is shown in FIG. 14. A fixture base 62*b* is pressed into the fixture 52*b*, and a fixture nut 62*a* is tightened over the fixture base 62*b* for holding the stream nozzle 38*b* in the fixture 52*b*. The stream nozzle 38*b* may be adjusted by loosening the fixture nut 62*b*, and held in position by tightening the fixture nut 62*b*. Water flowing through the stem 54 to the sprinkler nozzle 26 may pass through the center of the fixture 62 and into the stream nozzle 38*b*.

Figure 15:
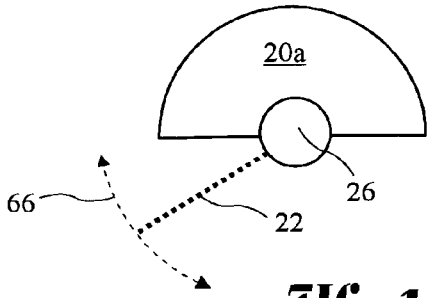
FIG. 15 is a top view of a half circle sprinkler pattern from a sprinkler nozzle and a water stream from the stream nozzle.

A top view of a half circle sprinkler pattern 20*a* from a sprinkler nozzle 26 and a water stream 22 from the stream nozzle 38*a* or 38*b* is shown in FIG. 15. The stream nozzle 38*a* may be adjusted in azimuth along arc 66 by tightening the sprinkler nozzle 26 more or less (as is typically done to adjust a sprinkler nozzle), and by bending the arm 36. The stream nozzle 38*b* may be adjusted in azimuth along arc 66 by rotating the collar 52*a* or 52*b*.

Figure 16:
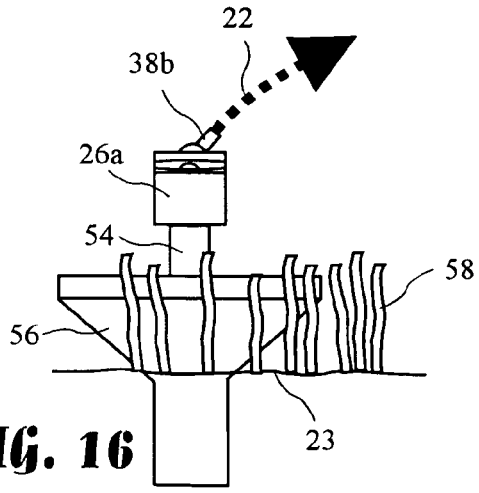
FIG. 16 is a second pop-up sprinkler nozzle including a stream nozzle according to the present invention.

A second pop-up sprinkler nozzle 26*a* including the stream nozzle 38*b* is shown in FIG. 16. The pop-up sprinkler nozzle 26*a* includes a stream nozzle 38*b* for providing a stream 22. The stream nozzle 38*b* is held in place in the same manner as described in FIGS. 9, 11, and 12.

Figure 17:
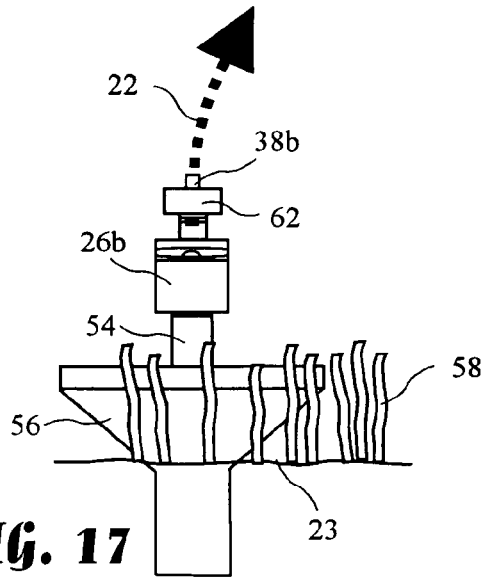
FIG. 17 is a third pop-up sprinkler nozzle with the stream nozzle attached by the nozzle fixture.

A third pop-up sprinkler nozzle 26*b* with the stream nozzle 38*b* attached by the nozzle fixture 62 is shown in FIG. 17. The nozzle fixture 62 is held in place in the same manner as described in FIGS. 10, 13, and 14.

Figure 18:
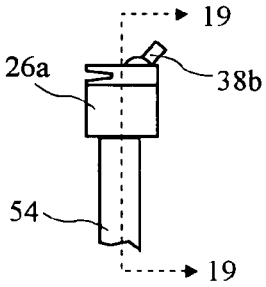
FIG. 18 is a front view of the stream nozzle attached to the second sprinkler nozzle.
Figure 19:
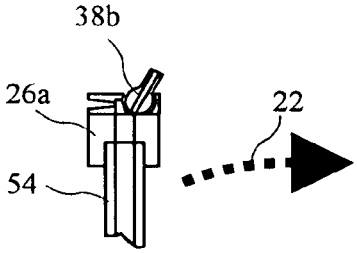
FIG. 19 is a cross-sectional view of the stream nozzle attached to the second sprinkler nozzle, taken along line 19-19 of FIG. 18.

A front view of the stream nozzle 38*b* attached to the second sprinkler nozzle 26*a* is shown in FIG. 18, and a cross-sectional view of the stream nozzle attached to the second sprinkler nozzle, taken along line 19-19 of FIG. 18. The second sprinkler nozzle 26*a* thus provides for attaching a stream nozzle directly to the sprinkler nozzle 26*a* and does not require a rotating collar between the water source and the sprinkler nozzle as described in FIGS. 9, 11, and 12.

Figure 20:
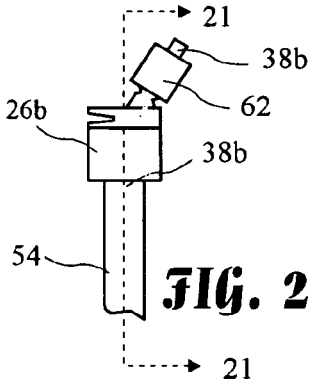
FIG. 20 is a front view of the stream nozzle attached to the third sprinkler nozzle by the nozzle fixture.
Figure 21:
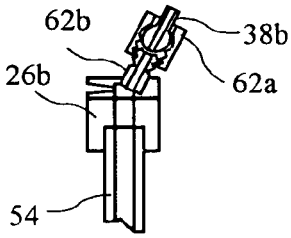
FIG. 21 is a cross-sectional view of the stream nozzle attached to the third sprinkler nozzle by the nozzle fixture, taken along line 21-21 of FIG. 20.

A front view of the stream nozzle 38*b* attached to the third sprinkler nozzle 26*b* by the nozzle fixture 62 is shown in FIG. 20, and a cross-sectional view of the stream nozzle 38*b* attached to the third sprinkler nozzle 26*b* by the nozzle fixture 62, taken along line 21-21 of FIG. 20, is shown in FIG. 21. The third sprinkler nozzle 26*b* thus provides for attaching a stream nozzle 38*b* directly to the sprinkler nozzle 26*a* using the nozzle fixture 62, and does not require a rotating collar between the water source and the sprinkler nozzle as described in FIGS. 10, 13, and 14.

Figure 22:
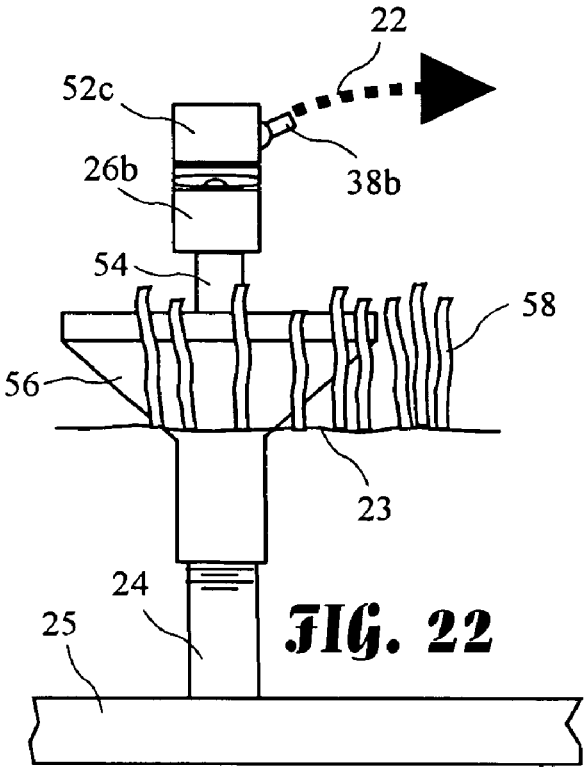
FIG. 22 is a front view of the stream nozzle attached to the rotating collar by swedging, the rotating collar residing above a sprinkler nozzle.

A front view of the stream nozzle 38*b* attached to a third collar 52*c* by swedging is shown in FIG. 22. The collar 52*c* resides above a second sprinkler nozzle 26*b*. The stream nozzle 38*b* is attached in a manner similar to that described in FIG. 12. The sprinkler nozzle 26*b* may be rotatably connected to the stem 54 in the same manner as the collar 52*a* shown in FIG. 12, or the collar 52*c* may be a rotating collar.

Figure 23:
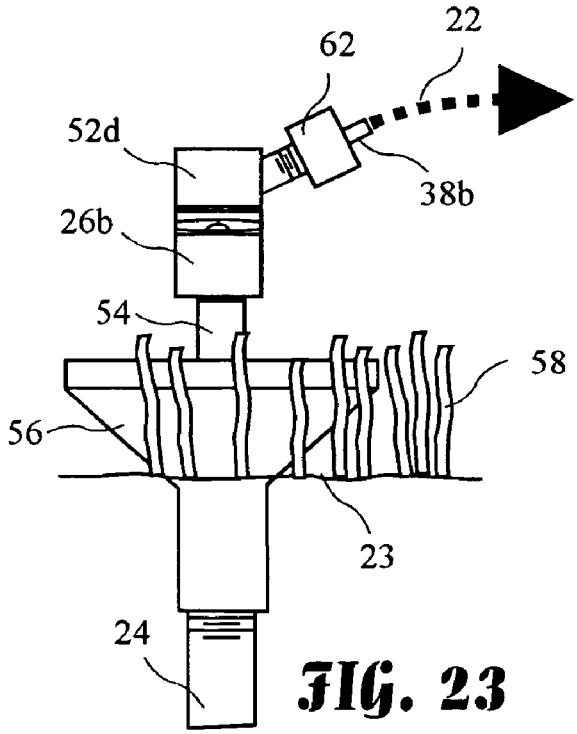
FIG. 23 is a front view of the stream nozzle attached to the rotating collar by the nozzle fixture, the rotating collar residing above a sprinkler nozzle.

A front view of the stream nozzle 38*b* attached to a fourth collar 52*d* by the nozzle fixture 62 is shown in FIG. 23. The collar 52*d* resides above the sprinkler nozzle 26*b*, but is otherwise similar to FIG. 14. The sprinkler nozzle 26*b* may be rotatably connected to the stem 54 in the same manner as the collar 52*a* shown in FIG. 12, or the collar 52*d* may be a rotating collar.

While the invention herein disclosed has been described by means of specific embodiments and applications thereof, numerous modifications and variations could be made thereto by those skilled in the art without departing from the scope of the invention set forth in the claims.

I claim:

1. A stream watering apparatus comprising:

a water source;

water pipes buried under ground and in fluid communication with the water source to received a flow of water from the water source;

at least one riser extending vertically from the buried water pipes to above ground and in fluid communication with the buried pipes to receive the flow of water from the buried pipes and carrying a straight and upward vertical flow of water;

an above ground end of the at least one riser;

a stream nozzle section connected to the above ground end of the at least one riser and residing directly above the riser and having a cylindrical vertical internal passage aligned with an interior passage of the riser for receiving the upward vertical flow of water from the riser the stream nozzle section including an adjustable stream nozzle extending from the side of the stream nozzle section to change an elevation angle of the stream nozzle for providing a stream of water for watering;

a vertical coupling connected to the stream nozzle section opposite the riser and residing directly above the riser and having a cylindrical vertical coupling internal passage aligned with the interior passage of the riser for receiving the upward vertical flow of water from the stream nozzle section; and a sprinkler nozzle connected to the vertical coupling and residing directly above the riser for receiving the upward vertical flow of water through the stream nozzle section and through the coupling and providing a pattern of water, independent of the stream of water, for watering an area.

2. The apparatus of claim 1, wherein the stream nozzle is adjustable to change an azimuth angle of the stream nozzle.

3. The apparatus of claim 1 further including a flow adjustment for the stream nozzle.

4. The apparatus of claim 1 further including a pressure regulator regulating a pressure of water provided to the stream nozzle.

5. The apparatus of claim 1, wherein the stream nozzle resides at an end of a bendable arm to adjust the azimuth angle and an elevation angle of the stream nozzle.

6. The apparatus of claim 5, wherein the bendable arm comprises a flexible tube and a wire residing inside the flexible tube.

7. The apparatus of claim 1, wherein the stream nozzle is pivotable to adjust the azimuth angle and the elevation angle.

8. The apparatus of claim 1, wherein the stream nozzle resides on an end of a bendable arm, the bendable arm comprising a flexible tube and a wire residing inside the flexible tube.

9. A stream watering apparatus comprising:

a water source;

water pipes buried under ground and in fluid communication with the water source to received a flow of water from the water source;

at least one riser extending vertically from the buried water pipes to above ground and in fluid communication with the buried pipes to receive the flow of water from the buried pipes and carrying a straight and upward vertical flow of water;

a pop-up sprinkler connected to the riser, the pop-up sprinkler comprising:

a pop-up stem;

a rotatable collar residing proximal to a top of the pop-up stem and rotatably connected to the pop-up stem and in fluid communication with the water source through the pop-up stem;

a sprinkler nozzle connected to the rotatable collar and residing directly above the rotatable collar and in fluid communication with the water source through the pop-up stem and through the rotatable collar for providing a sprinkler pattern; and a stream nozzle attached to the rotatable collar, the stream nozzle being adjustable to independently change an elevation angle of the stream nozzle for providing a stream of water independent of the sprinkler pattern.

10. The apparatus of claim 9, wherein the stream nozzle includes a ball and socket for adjusting the direction of the stream nozzle.

11. A stream watering apparatus comprising:

a water source;

water pipes buried under ground and in fluid communication with the water source to received a flow of water from the water source;

at least one riser extending vertically from the buried water pipes to above ground and in fluid communication with the buried pipes to receive the flow of water from the buried pipes and carrying a straight and upward vertical flow of water;

a pop-up sprinkler connected to the riser, the pop-up sprinkler comprising:

a pop-up stem;

a stream nozzle section attached to the pop-up stem and receiving the flow of water through the pop-up stem;

a sprinkler nozzle connected to the stream nozzle section and residing directly above the stream nozzle section and in fluid communication with the water source through the stream nozzle section for providing a sprinkler pattern; and a stream nozzle connected to the stream nozzle section and being adjustable to independently change an elevation angle of the stream nozzle and providing a stream of water independent of the sprinkler pattern.

12. The stream watering apparatus of claim 11, wherein the stream nozzle section is further adjustable to independently change an azimuth angle of the stream nozzle independent of the pop-up stem.

13. The stream watering apparatus of claim 12, wherein the stream nozzle includes a ball and socket for adjusting the elevation and azimuth of the stream of water.

* * * * *